United States Patent [19]

Hartman et al.

[11] 3,952,677

[45] Apr. 27, 1976

[54] CURLED CONTAINER BODIES, METHOD OF SECURING CLOSURES THERETO AND CONTAINERS FORMED THEREBY

[75] Inventors: William Herman Hartman, Rolling Meadows; Frank Bruno Pas, Carpentersville; Joseph Lambert Godar, Wauconda, all of Ill.

[73] Assignee: American Can Company, Greenwich, Conn.

[22] Filed: June 27, 1974

[21] Appl. No.: 483,761

[52] U.S. Cl. ..... 113/120 Y

[51] Int. Cl.[2] ..... B21D 51/26

[58] Field of Search..... 113/120 H, 120 XY, 120 Y, 113/120 AA, 120 S, 120 K

[56] References Cited

UNITED STATES PATENTS

| | | | |
|---|---|---|---|
| 2,250,002 | 7/1941 | Bogner | 220/67 |
| 2,337,452 | 12/1943 | Compo | 113/120 Y |
| 2,382,378 | 8/1945 | Bloedorn | 113/120 Y |
| 2,465,755 | 3/1949 | Sanders | 113/120 Y |
| 2,576,446 | 11/1951 | Condon | 113/120 XY |
| 3,385,249 | 5/1968 | Czarnecki | 113/120 AA |
| 3,785,311 | 1/1974 | Yoshikawa | 113/120 H |
| 3,882,763 | 5/1975 | Ellerbrock et al. | 113/120 Y |

*Primary Examiner*—C. W. Lanham
*Assistant Examiner*—E. M. Combs
*Attorney, Agent, or Firm*—Robert P. Auber; Paul R. Audet; George P. Ziehmer

[57] ABSTRACT

An open-ended cylindrical container body whose body wall marginal open end portion includes an annular body curl, and comprises metal less than about 0.0057 inch thick for a drawn and ironed container body, and less than about 0.002 inch for the metal foil liner of a composite container body, a method of securing a metal end closure to the curled container bodies by mechanical engagement and compression of end portion of the end closure cover hook substantially axially against the body curl, and the hermetic pressure-resistant containers formed therby.

4 Claims, 21 Drawing Figures

PRIOR ART

CURLED CONTAINER BODIES, METHOD OF SECURING CLOSURES THERETO AND CONTAINERS FORMED THEREBY

BACKGROUND OF THE INVENTION

This invention relates to containers whose body walls are comprised of a layer of very thin metallic material. More particularly, this invention relates to body curls at the marginal end portions of such containers and to the art to hermetically securing metal end closures to such curled containers for packaging pressurized products therein.

Presently, there is a desire among can manufacturers to reduce the overall cost of manufacturing containers especially those used for packaging pressurized products such as beer and carbonated beverages. There have been at least two main approaches to cost reduction. One has been to further reduce the body wall thicknesses of already thin highly-directional highly-worked containers such as aluminum and steel drawn and ironed containers, for example, for aluminum, from about 0.008 at the open marginal end portion and about 0.006 inch therebelow, to less than about 0.0057 inch overall, and for steel, from about 0.0068 inch at the open marginal end portion and about 0.0045 inch therebelow, to less than about 0.004 inch overall. The other approach has been to substitute the aforementioned thin highly-worked metal containers with less costly composite ones whose body walls include a fibrous layer and an inner layer of full hard metal foil whose temper is about H19 and whose thickness is about 0.001 inch.

Both of these approaches have heretofore been unsuccessful because, in securing metal end closures to drawn and ironed aluminum container body walls less than about 0.0083 inch, drawn and ironed steel container body walls less than about 0.0053 inch thick, and composite container body walls whose foil liners are less than about 0.002 inch thick, hermetic seals or seams resistant to product internal pressures could not be obtained. The reason in each case is that conventional double seaming methods have been used. These require forming a conventional flange of the marginal end portion of the container body walls. But conventional 0.090–0.100 inch flanges cannot be formed of the marginal end portions of such thin highly-directional highly-worked metal containers, because the wall metal there will not elongate to the extent required. It is too thin, too brittle, and elongation during flanging occurs in the same axial grain direction created in the drawing and ironing process. This inability to elongate as required produces cracks in the flanges and such flanges preclude obtaining hermetic pressure resistant seams such as double seams.

Flanges cannot be used on composite container bodies because the thin hard foil liner likewise often cracks due to elongation during flanging.

Heretofore, can manufacturers have sought to overcome flange cracking and resulting inhermetic seams by necking-in or providing extra metal in certain end regions of can body walls for example by beefing up the thickness of the metal there by about 0.002 inch or more and by use of sealant materials in double seams. Neither remedy prevents cracks in flanges and each remedy is costly and brings on its own problems. For example, providing extra metal at end regions of drawn and ironed bodies makes it difficult to strip them from their drawing punches.

Even if uncracked flanges satisfactory for seaming could be obtained in these thin highly-worked container bodies, flanges in such bodies would be less than desirable because they are sharp and can cause damage to sealing rubber gaskets of can testing and can filling machines. Also, flanged thin highly-worked metal container bodies are usually weak at their upper regions and are highly susceptible to denting, crushing and other abuse during storage and handling.

It has now been found that by employing a body curl instead of a flange, the aforementioned flange-related problems are reduced and hermetic seams resistant to product internal pressures can be obtained. Body curls have been found to require less metal elongation than conventional flanges. Whereas the latter requires 7–8% elongation, the former requires less than about 4% elongation. Because of this, body curls formed of extremely thin highly-worked metal containers rarely have cracks or puckers, and any cracks which might be formed in the foil liner of the composite fibrous container body curl are so slight that they do not interfere with the formation of hermetic pressure resistant seams.

It has also been found that hermetic pressure-resistant seams between metal end closures and containers for pressurized products such as beer and carbonated beverages, can be formed by a mechanical interference between, and the substantially axial compressive force exerted by, the end portion of the end closure cover-hook and the compressed marginal end portion of the container body curl. A thermoplastic adhesive that need not require heat activation, placed between the vertical end closure countersink wall and the metal container body wall, assists in making the seam pressure resistant. The adhesive also protects the edge of the body wall from contact with the packaged product.

The aforementioned compressive interference seam saves metal because the metal end closure flange need not be as long as a conventional one for double seaming. This seam is also advantageous because it can be formed with only minor adjustments to conventional double seaming equipment.

In view of the above shortcomings of flanging, and of the above and other advantages of curling the marginal end portions of the aforementioned very thin metal walled container bodies, as well as of seaming them to metal end closures by a substantially axial compressive interference seam, it is an object of this invention to provide an open-ended cylindrical metallic container body whose wall comprises metal whose thickness adjacent its open end is less than about 0.0057 inch and whose marginal end portion is in the form of a body curl capable of forming hermetic pressure-resistant seams with metal end closures.

Another object of this invention is to provide very thin highly-worked drawn and ironed containers for beer and carbonated beverages wherein the container body wall has a uniform thickness of less than 0.0057 inch.

Another object of this invention is to provide the aforementioned container wherein the uniform thickness for drawn and ironed aluminum containers is about 0.0053 inch and for drawn and ironed steel containers is about 0.0038 inch thick.

Another object of this invention is to provide an open-ended cylindrical metallic drawn and ironed container body capable of holding internal pressures of from 60–90 psi at elevated temperatures of up to around 130° and 140°F, whose body wall is comprised of metal whose thickness at its marginal end portion is less than 0.0057 inch, is in the form of a body curl whose edge points toward the container body wall and which is capable of forming a hermetic pressure-resistant seam.

Another object is to provide an open-ended composite cylindrical container body whose full hard metal foil liner is less than about 0.002 inch thick and whose marginal open end portion includes a body curl.

Another object of this invention is to provide a method of hermetically and pressure resistantly securing a metal end closure to a container body whose body wall comprises metal whose thickness is less than 0.0057 inch.

Another object of this invention is to provide the aforementioned method wherein the container body wall is comprised of extremely thin highly-worked drawn and ironed and like metallic materials.

Another object of this invention is to provide the aforementioned method wherein the container body wall is comprised of a layer of fibrous material and an inner layer of full hard metal foil whose thickness is less than about 0.002 inch.

Another object of this invention is to provide a hermetic pressure-resistant seam between a metallic end closure and a container body whose wall adjacent its marginal end portion is in the form of a body curl and which comprises a layer of metallic material whose thickness is less than 0.0057 inch.

Still another object of this invention is to provide the aforementioned seam wherein the seam is effected by the mechanical interference between and the substantially axial compressive force exerted by the metal end closure hook and the body curl.

Still another object of this invention is to provide a thin-walled container for beer and carbonated beverages having a seam of the aforementioned type.

Yet another object of this invention is to provide a sealed thin-walled container of the aforementioned type wherein the thickness of the container body wall is uniform.

These and other objects and advantages of this invention will be apparent as it is better understood from the description which follows, which taken in conjunction with the drawing discloses preferred embodiments thereof.

BRIEF DESCRIPTION OF THE DRAWINGS

FIG. 8, a cross section of the upper end portion of a conventional thin-walled metal container body, FIG. 9, a cross section of the body wall portion of FIG. 8 after it has been flanged, and FIG. 10, a side elevational view of FIG. 9.

DETAILED DESCRIPTION OF THE DRAWINGS

Figure 1:
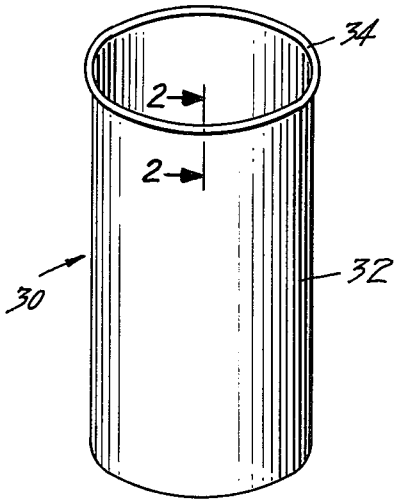
FIG. 1 is a perspective view of a curled thin-walled container body.

FIG. 1 is a perspective view of an open ended cylindrical container body 30 having an integral bottom wall (not shown) and a body wall generally designated 32 having its upper open marginal end portion in the form of an annular substantially full body curl 34. Open ended container body 30 is a very thin highly worked metal container such as a drawn and ironed aluminum or steel container as employed for packaging pressurized products such as beer and carbonated beverages. The thickness of the marginal end portion of the body wall is less than about 0.0057 inch. This portion of the body wall is usually thicker than lower body wall portions whose thickness may be about 0.0053 inch for drawn and ironed aluminum and about 0.0038 inch for drawn and ironed steel containers. Advantageously, the body wall thickness is substantially uniform and is about 0.0048 inch for drawn and ironed aluminum containers and about 0.0038 inch for drawn and ironed steel containers.

Figure 2:
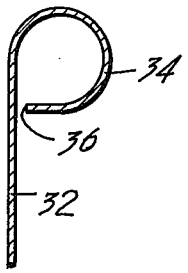
FIG. 2 is an enlarged cross section taken substantially along line 2—2 of FIG. 1.

FIG. 2 is an enlarged cross section taken substantially along line 2—2 of FIG. 1 showing a tight substantially full body curl 34 which can have a radius ranging from about 0.007 to 0.035 inch preferably about 0.030 inch for aluminum, and about 0.025 inch for steel drawn and ironed containers, the latter being understood to include both black plate, and tin plate steel containers. Curl 32 is shown having an edge 36 adjacent and facing or pointing toward body wall 32.

Figure 3:
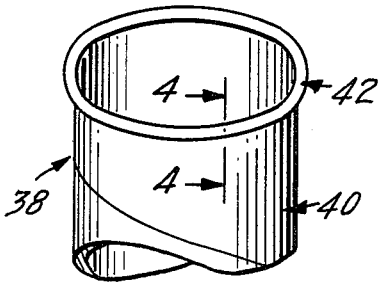
FIG. 3 is a perspective view of an upper portion of a curled composite container body.

FIG. 3 is a perspective view with portions broken away of the upper end of an open ended substantially cylindrical composite container body generally designated 38 having a side wall generally designated 40 and at its upper open end, an annular outwardly extending full body curl 42.

Figure 4:
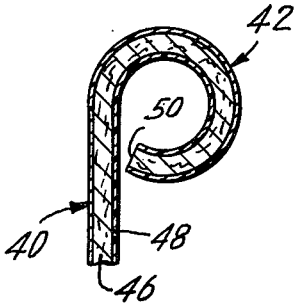
FIG. 4 is an enlarged cross section taken substantially along line 4—4 of FIG. 3.

FIG. 4 is an enlarged cross section taken substantially along line 4—4 of FIG. 3. More particularly, FIG. 4 shows that composite body side wall 40 is comprised of an inner layer 44 of full hard metal foil, an adjacent layer of fibrous material 46, and an outer protective layer 48. Inner layer 44 can be any full hard aluminum or steel foil ranging in thickness from about 0.001 to 0.002 inch, which is capable when combined with an outer fibreboard layer of withstanding internal pressures of up to about 90 psi at elevated temperatures of up to about 140°F. A preferred foil is 0.001 inch 5052 H19 temper full hard aluminum. A suitable steel foil is a Double Cold Reduced tin plated foil. Fibrous material 46 can be any suitable fibrous material used for making composite containers. Preferably, it is a 42 No. Kraft paperboard. This may be laminated or adhered to the 0.001 inch unsupported foil inner layer. The kraft board has a polyethylene inner surface which is bonded to the foil outer polyethylene surface. A suitable commercial paper backed foil material is 0.00035 inch aluminum foil/25 No. MGK paper manufactured and sold by Anaconda Aluminum Company. Though not shown in the drawings, the outer surface of the foil can be coated with a suitable primer such as a Titanium Acetylacetonate material and a layer of extruded polyethylene, and the inside coated with a suitable modified epoxy material. Outer protective layer 48 can be a label made of conventional materials such as thermoplastics, preferably polyethylene, or it can be paper or foil, or combinations thereof. Typically layer 48 is about 0.002 to 0.004 inches thick.

FIG. 4 shows that the upper open end of composite container body wall 40 is in the form of a tight annular outwardly-extending substantially full body curl 42 whose edge 50 is adjacent and faces or points toward body wall 40. The radius of the composite body curl can range from about 0.020 to 0.035 inch, preferably about 0.027 inch, when the composite body wall thickness is from about 0.015 to 0.020 inch.

Figure 5:
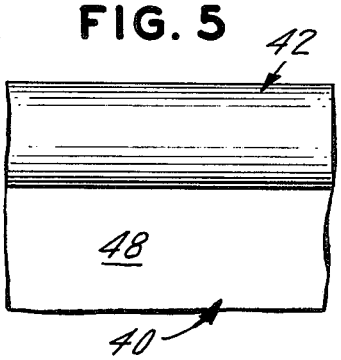
FIG. 5 is a side elevational view with portions broken away, as would be taken of FIGS. 2 or 4.

FIG. 5, a side elevation, shows that the composite body curls 34, 42 of FIGS. 2, 4 are smooth, continuous and contiguous and do not have cracks and/or puckers therein.

Figure 6:
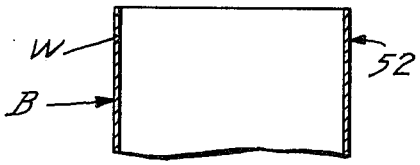
FIG. 6 is a cross section of the upper open end of a thin walled cylindrical container body before it is curled.

FIG. 6 is a side elevation of an upper portion of substantially cylindrical container body B having a substantially straight body wall W uncurled at its marginal end portion 52. Body wall W can be that designated 32 in FIGS. 1 and 2, or 40 in FIGS. 3–5.

Figure 7:
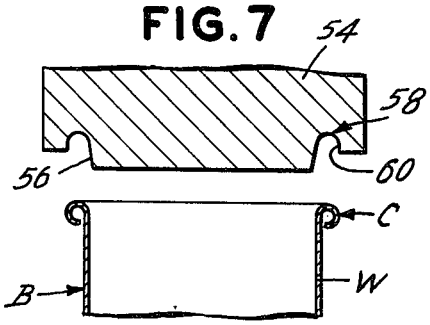
FIG. 7 shows the container body of FIG. 6 after it has been curled.

As shown in FIG. 7, a curl here generally designated C is formed of the marginal end portion 52 of container body B by conventional curling means such as a roll, or as shown, a die or chuck 54 having a frustoconical chuck wall 56 which merges into a U-shaped inverted channel 58 which in turn merges into skirt wall 60. Chuck 54 is moved vertically downward over the marginal end portion 52 of container body B to form a curl 34, 34' or 42. The curl edge, here generally designated E follows the contour of chuck wall 56, channel 58 and skirt 60 and thereby forms body curl, here designated C, whose edge E is adjacent and points toward container body wall W.

Figure 8:
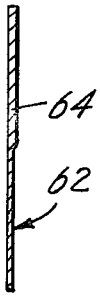
FIGS. 8, 9, and 10 show prior art.
Figure 9:
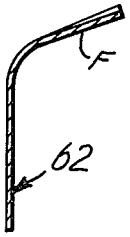
Figure 10:
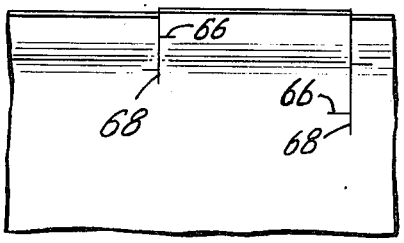

FIG. 8 is an enlarged cross section through an upper portion of a conventional thin walled metallic drawn and ironed container body 62 and shows that the marginal edge portion 64 thereof is thicker than the rest of body wall 62. The presence of this extra material was heretofore necessary to allow elongation during the formation of conventional flange F. But, as shown in FIGS. 9 and 10, even with the extra metal, flanges F formed therefrom, in contrast with the smooth continuous curl 42 of FIG. 5, still tend to include enough cracks 66 and 68 to render flanging of the marginal end portions of thin walled metallic container bodies less than satisfactory for forming hermetic, pressure-resistant seams.

It is to be noted that when comparing curls with conventional flanges, a reason for the lack of cracks in curls is that the marginal end portions of the thin metallic body walls are worked or elongated from about 33 to about 50 per cent less when curls rather than flanges are formed. This reduction in elongation occurs whether the very thin metallic material of the body wall is highly worked aluminum or steel or whether it is full hard steel or aluminum foil. It applies whether the foil is heat treated and/or coated for example with conventional primers such as acetylacetonates, slip coatings such as modified epoxies, adhesives such as ethylene acrylic acid copolymers and polyethylenes, or combinations thereof, and it occurs regardless of whether there is a layer of fibrous material alone or with a protective layer such as a label thereover.

Figure 11:
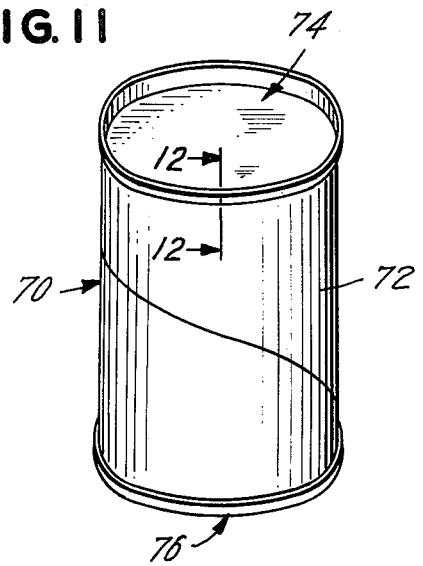
FIG. 11 is a perspective view of a three piece cylindrical composite container.

FIG. 11 is a perspective view of a three-piece spirally-wound composite container 70 having a substantially cylindrical side wall 72 and having secured to its top and bottom end portions, top end closure 74, and bottom end closure 76.

Figure 12:
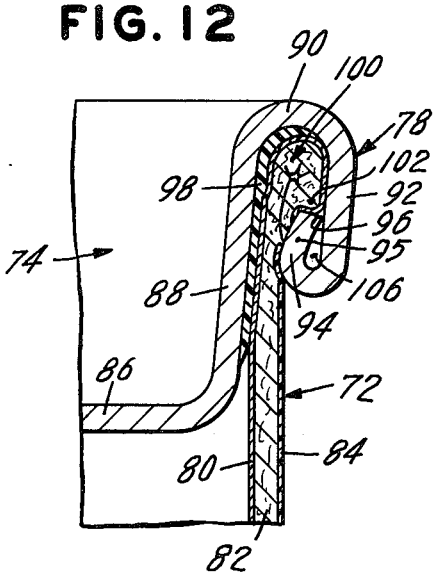
FIG. 12 is an enlarged cross section taken substantially along line 12—12 of FIG. 11.

FIG. 12, an enlarged cross section taken substantially along line 12—12 of FIG. 11, shows top end closure 74 bondedly secured to cylindrical composite container body wall 72 by a seam generally designated 78. More particularly, FIG. 12 shows that substantially cylindrical composite side wall 72, like side wall 40 of FIG. 4, is comprised of an inner layer of full hard metal foil 80, an adjacent layer of fibrous material 82 and an outer protective layer 84, which can be a label made of conventional material such as thermoplastics, paper, or foil, or combinations thereof. Inner layer 80 can be full hard metal foils such as steel, e.g. a double cold reduced ETP 2CR steel foil, or, as preferred, a 5052 H19 temper aluminum foil. Fibrous material 82 can be any suitable conventional material used for forming composite cans. Desirably, it is a 42 No. Kraft paperboard. The outer protective layer 84 shown is polyethylene. Preferably it is of low density.

Prior to having end closure 74 secured thereto, composite body side wall 72 was initially substantially cylindrical, as shown in FIG. 6, and its marginal end portion was thereafter formed into an annular body curl C as in FIG. 7 or, more particularly, 42 as in FIG. 4.

As shown in FIG. 12 metal end closure 74 which can be aluminum or steel has a central panel 86 and peripheral thereto a substantially vertical countersink wall 88 which merges into an arcuate portion 90, an annular peripheral depending skirt 92 which merges into a closure cover hook 94 having an edge 96.

A hermetic, pressure resistant securement of top metal end closure 74 to curled composite cylindrical container body 72 is effected to some extent by sealant material 98 interposed between a portion of substantially vertical, countersink wall 88 and arcuate portion 90 and an upper portion of body wall 72, but mainly by a mechanical engagement of or interference between and a compressive force exerted by closure hook end portion 95 including edge 96 substantially axially against the body curl, more particularly, against the end portion 102 of a now compressed body curl 100. In the various configurations of seam 78 shown, sealant material 98 is not needed and preferably none is present between the outer portions of compressed body curl 100 and skirt 92, and no sealant material appears in void 106. Though closure hook 95 is shown as bent back upon and touching closure skirt 92, the closure hook can be spatially removed therefrom and can have various configurations as will be shown in FIGS. 13–15.

Figure 13:
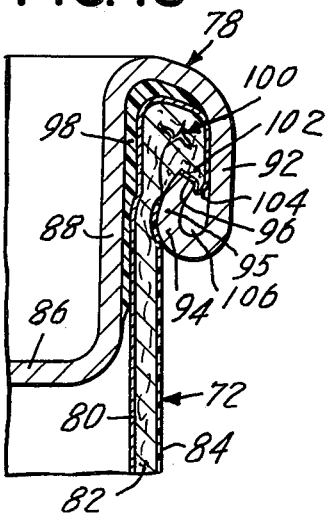
FIGS. 13–15 are enlarged cross sections as would be taken along line 12—12 of FIG. 11 showing other embodiments of hermetic seams.
Figure 14:
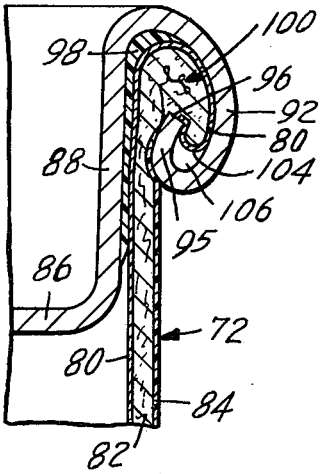
Figure 15:
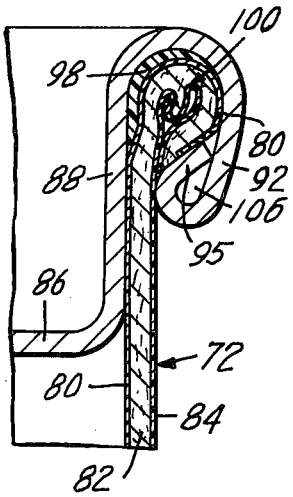

FIGS. 13–15 are enlarged cross sections as would be taken substantially along a line similar to that shown as 12—12 of FIG. 11, showing various embodiments of seams within the scope of this invention. FIG. 13 shows closure hook end portion 95 spatially removed from closure skirt 92 and pinching a rather tight fold 104 of the end portion of the compressed body curl 102.

FIG. 14 shows closure hook end portion 95 more spatially removed from skirt 92 than it is in FIG. 13 and it shows it pinching a larger, more arcuate folded portion 104 of full hard aluminum foil 80. Closure hook edge 96 engages only a portion of the end of full hard foil 80.

In FIG. 15, closure hook 95 is bent sharply back upon skirt 92 so that a portion of the interiormost surface of closure hook 95 abuttingly engages the outer surface of the end portion of full hard foil 80 of substantially axially compressed curl 100. The seam, in most instances, has a void area, in the substantially U-shaped arcuate portion between closure hook 95 and closure depending skirt 92. The shape of depending skirt 92 can vary for example from substantially vertical as shown in FIGS. 12 and 13 to more or less arcuate as shown in FIGS. 14 and 15. Also, outer protective layer 84 can either terminate below and not form part of compressed body curl 100, as in FIGS. 12–14, or it can extend into a portion or part or all of compressed body curl 100 as shown in FIG. 15.

Figure 16:
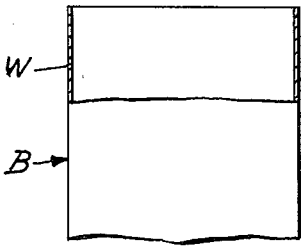
FIGS. 16–18 are side elevations with portions broken away and partially in cross section, showing the method of this invention, FIG. 16 showing an uncurled thin-walled cylindrical metallic container body, FIG. 17 the container body of FIG. 16 after it has been curled, and FIG. 18 an end closure being applied to the curled container body of FIG. 17.
Figure 17:
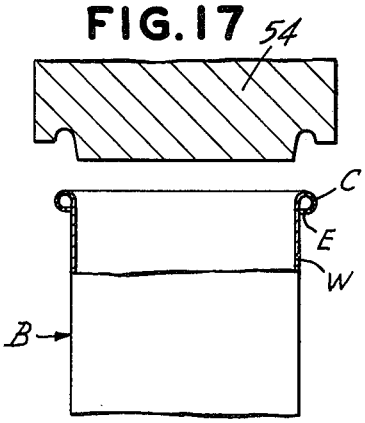
Figure 18:
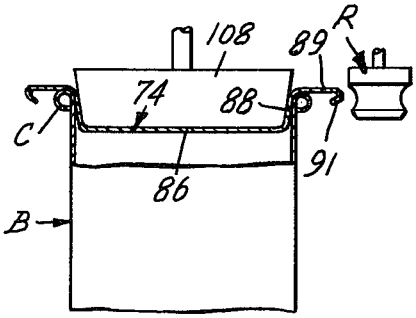

FIGS. 16–18 show the method of forming a hermetic pressure resistant seal between a metal end closure and an open-ended container body whose body wall is less than 0.006 inch thick adjacent its open end. More particularly, FIG. 16 is a side elevational view with portions broken away and partially in cross section, showing that in the method, an uncurled substantially cylindrical open-ended container body B is provided whose substantially straight body wall W is substantially straight and uncurled adjacent its marginal end portion. The body wall can either be a very thin highly worked aluminum or steel such as in a drawn and ironed container as in FIGS. 1 and 2 or a composite material as in FIGS. 3–5 and 11–15.

As shown in FIG. 17, and as previously explained for FIGS. 6 and 7, an annular body curl C is formed of the marginal end portion of container body B by conventional curling means such as chuck 54 in a manner that curl edge E is adjacent and points toward container body wall W.

As shown in FIG. 18, a hermetic securing of metal end closure 74 to the curled container body B to form a container capable of holding internal pressures of up to 90 lbs per square inch developed at elevated temperatures of up to about 140°F, is effected for example by providing metal container end closure 74, providing a sealant material S which can be that shown as 98 or 128, and moving a chuck 108 vertically downward onto the central panel 86 of closure 74 so that chuck peripheral wall 110 provides a rigid backing for forming a seam with roller R. As in the conventional seaming operation, when roller R is rotating and brought substantially horizontally radially into contact with end closure 74, closure flange 89 is bent inward to form skirt 92, closure curl 91 forms closure hook 94 having edge 96, and the closure end portion 95 and/or edge E mechanically engages and compresses body curl C.

Figure 19:
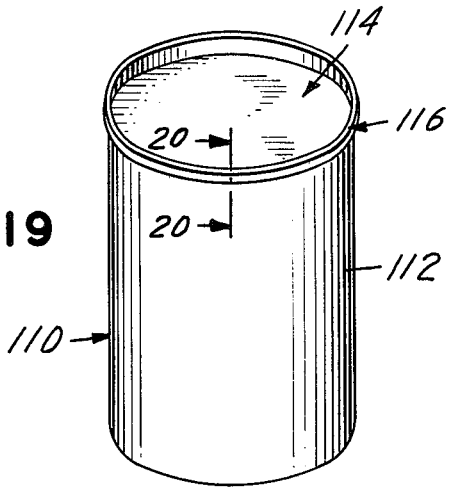
FIG. 19 is a perspective view of a two-piece thin-walled cylindrical container.

FIG. 19 is a perspective view of another very thin highly worked two-piece metal container generally designated 110 previously shown, having a substantially cylindrical side wall 112, an integral bottom wall (not shown), and secured thereto, a metal end closure 114. Container 110 is formed of a container body as described for FIGS. 1 and 2, 6–10 and 16–18 the method of this invention previously described and shown in FIGS. 16-18.

Figure 20:
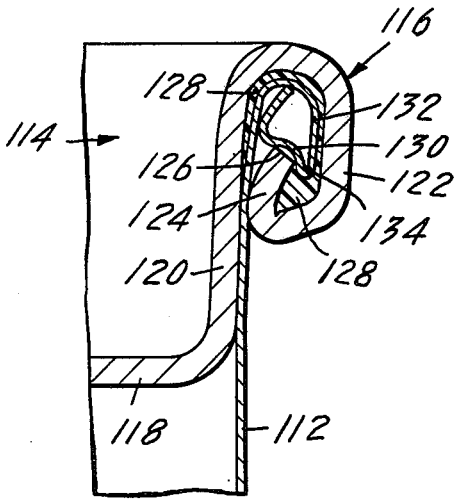
FIG. 20 is an enlarged cross section taken substantially along line 20—20 of FIG. 19.

FIG. 20, an enlarged cross-section taken substantially along line 20—20 of FIG. 19, shows the figuration of seam 116 wherein metal end closure 114 is secured to container body side wall 112 in a manner similar to the configuration of seams shown in FIGS. 12–15 for composite containers. Metal end closure 114 has a central panel 118 having a substantially vertical countersink wall 120 merging into a peripheral depending skirt 122 which in turn merges into a closure hook 124 having an edge 126. Seam 116 is hermetic end pressure resistant due to the action of sealant material 128 and the mechanical interference between and compressive force exerted by closure hook edge 126 substantially axially against end portion 130 of the body curl of FIG. 2 now compressed into curl 132.

For very thin highly-worked container bodies, a sealant material 128 usually a rubber-type material, is placed between the outer surface of curl 132 and the inner surface of closure skirt 122, and it can appear in the channel formed by the skirt and coverhook 124.

Figure 21:
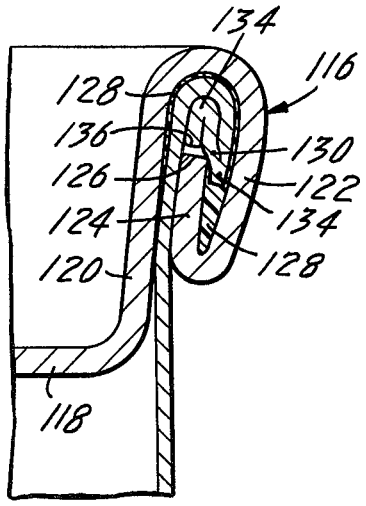
FIG. 21 is an enlarged cross section as would be taken along line 20—20 of FIG. 19 showing another embodiment of a hermetic seam.

FIG. 21 is another embodiment of seam 116 wherein coverhook end portion 124 mechanically buttingly engages body end portion 130 and marginal end portion 134 is folded back upon itself so that its edge 136 points toward closure hook edge 126. The voids adjacent and within substantially axially compressed curl 132 of FIG. 20 do not appear in FIG. 21.

The radius of the curls of this invention can be any suitable radius wherein the edge of the body curl points toward the container body wall and which will permit the hermetic pressure-resistant seams of this invention to be formed. The radius of the curl must be greater than the thickness of the wall metal which forms the curl. It has been found that the range of suitability of the curl varies depending on the body wall material employed. Generally, when the radius is too large cracking occurs, and when too small a curl cannot be formed. Generally, for composite materials, acceptable radii would be within from about 0.020 to about 0.035 inch and for aluminum and steel drawn and ironed containers from about 0.007 to about 0.035 inch.

From exemplary FIGS. 12–15 and 20–21, it can be seen that there are a very large number of possible seam configurations each being acceptable so long as the aforementioned mechanical interference compressive force forms a hermetic seam which resists internal pressures of up to 90 psi developed at about 140°F. Preferably, there is a pinched fold of curled metal such as 104 in FIG. 13, 100 in FIG. 15, and 134 in FIGS. 20 and 21.

The Table below shows that as compared to conventional flanges, curls require less body metal for their formation, their percent elongation is less, they had practically no cracks therein, and the composite body curls that were cracked were still acceptable for forming hermetic pressure resistant seams. It is to be noted that, as compared with these results, 100% of the conventional flanges of 0.090 to 0.100 inch length formed on container bodies tested of the type listed in the TABLE had cracks therein which rendered them unsuitable for forming hermetic, pressure-resistant seams.

TABLE

| Container Body Material | Thickness (inches) | Grain Direction | % Elongation Strip (2 inch) | % Elongation Curl | Flange Width (inches) | Curl Diameter (inches) | Cracks |
|---|---|---|---|---|---|---|---|
| Drawn and Ironed | | | | | | | |
| Aluminum | 0.0048 | Vertical | 2.0% | 4.70% | 0.092(±.007) | 0.060 | None |
| Steel | | | | | | | |
| Tinplate | 0.0038 | Vertical | 0.8% | 3.50% | 0.092(±.007) | 0.045 | None |
| Blackplate | 0.0038 | Vertical | 1.0% | 3.50% | 0.092(±.007) | 0.045 | None |
| H19 Full Hard Aluminum Foil, | 0.001 | | | | | | 1 can out of 100 tested** |
| Fibre (42 No. Kraft Paperboard), | 0.011 | 30° to axis | 2.5% | 4.20% | Varies | 0.054 | 6 cans out of 100 tested** |
| Low Density Polyethylene.* | 0.005–0.008 | | | | | | |

*Natural Grade produced and sold under the Trade Designation NA203 by United States Industries.

**In two runs, the respective single and six cans that had cracks were still acceptable for forming hermetic pressure-resistant seams.

Materials which can be employed as sealants in the seams of this invention can be any suitable thermoplastic adhesive for sealing metal end closures to containers having composite or thin highly-worked metal container bodies. In addition, any suitable rubber material can be used for the thin highly-worked metal bodies. Although thermoplastic adhesives are not usually employed as sealants in seams because they do not have adequate peel strength, the substantially straight countersink walls and large substantially flat surface areas of adjacent countersink and body wall portions of the seams of this invention reduce the need for peel strength and require and take full advantage of the relatively good shear strength of the thermoplastic adhesives to provide seams which resist product internal pressures. Whatever the sealant employed, it must be compatible and coordinated with coating materials usually applied to the surfaces of the metal end closures and the container bodies to insulate them from corrosive products. Protective coatings (not shown) often utilized with thermoplastic adhesives for metallic container bodies are vinyl type coatings over modified epoxy-type base coatings and, for composite bodies, modified epoxy-type coatings with slip compounds, the latter for lubricating the container body during its formation.

The thermoplastic adhesives which can be employed in the seams of this invention are heat activatable adhesives based on an ethylene acetate terpolymer, a butadiene-styrene-block copolymer, and a polyamide polymer. Because their shear strength is being relied upon, these adhesives need not be heat activated to be effectively employed in the seams of this invention.

The ethylene-vinyl-acetate acid terpolymer based adhesive is produced by mixing 65 parts by weight of an ethylene-vinyl-acetate organic acid terpolymer with 35 parts by weight of a polyterpene resin. This is then dissolved in 200 parts by weight of a heated solvent such as an aromatic petroleum hydrocarbon. The solution is cooled with a hard gel which is reheated to about 150°F., when applied to the container components. The coated components are cured at 200°F. to drive off the solvent. The adhesive lined ends or container bodies may then be stored until ready for attachment at which time the adhesive can but need not be reactivated by heating to 300° F. and used to adhesively bond the end closures to the container bodies. The ethylene-vinyl-acetate organic acid terpolymer preferably has a 20% by volume vinyl acetate content with an acid number of six. An example of a preferred ethylene-vinyl-acetate organic acid terpolymer is manufactured by E. I. DuPont de Nemours and Company and sold under the trade designation EP-3656-9.

The butadiene-styrene-block copolymer based adhesive is produced by mixing 56.71 parts by weight of a styrene-butadiene-block copolymer, having 25% by volume of the styrene molecule and 75% by volume of the butadiene molecule, with 21.22 parts by weight of a polyterpene resin, 21.22 parts by weight of a commarone-indene resin, and 0.85 parts by weight of an antioxidant. This is dissolved in 200 parts by weight of a heated solvent, such as an aromatic petroleum hydrocarbon. When the solution cools it thickens slightly and can be applied without reheating. Examples of commercially available styrene-butadiene-block copolymers suitable for such use are Kraton 1101 and 1102 as produced by the Shell Chemical Company.

The polyamide polymer based adhesive is produced by mixing 75 parts by weight of a polyamide, having a melt index range of 6 to 15 at 401°F. and which also must be soluble and remain a liquid solution at room temperature, with 25 parts by weight of a polyterpene resin. This is then dissolved in heated solvents comprising 200 parts by weight of an aromatic petroleum hydrocarbon, 60 parts by weight of an acetone free diacetone alcohol and 60 parts by weight of an isopropyl alcohol. The solvents are heated to about 150°F. in order to provide a solution. The adhesive remains a homogeneous liquid mixture when cooled to room temperature and can be applied anytime as such and heated to drive off the solvents. The adhesive can then be reactivated and the ends applied to the container bodies by heating the adhesive to about 400°F. Examples of commercially available polyamides suitable for such use are Milvex 1000 and Milvex 4000 produced by General Mills Inc.

Rubber materials employable as sealants in seams of this invention are for example organic solvent-soluble styrene-butadiene copolymer rubber materials. Suitable such materials and their methods of preparation are disclosed in U.S. Pat. No. 2,767,152 issued on Oct. 16, 1956. These copolymer rubber materials usually contain from 10 to 90 parts by weight styrene and 90 to 10 parts by weight butadiene, based on the weight of the copolymer. A commercially available styrene-butadiene rubber suitable for forming sealants for seams for beer and carbonated beverages is that manufactured by and sold by the B. F. Goodrich Chemical Company under their Registered U.S. Trademark Ameripol. The copolymer can be physically mixed with other rubbers for desired properties, for example with small amounts of a non-soluble acrylonitrile, or butadiene-acrylonitrile copolymer rubber to increase toughness. The rubber materials often comprise about equal parts of about 33 weight percent styrene-butadiene copolymer rubber, about 33 weight percent tackifying resin such as polyterpene, and about 35 weight percent of other materials such as fillers, pigments, etc., these weight percents being based on the total weight of the rubber sealant material.

A commercially available polyterpene resin suitable for beer and carbonated beverage container seams is that manufactured by The Newport Division of, and sold under the Registered U.S. Trademark "Nirez" owned by the Heyden Newport Chemical Company.

The rubber sealant materials are usually prepared by dissolving the tackifying resin within an organic solvent for example a naptha, hexane or heptane, and adding the filler to the solution until it is dispersed therein. The styrene-butadiene rubber, preferably in crumb form, is then added to the dispersion and the mixture is maintained at about 100°F while it is agitated for from about four to ten hours.

The resulting sealant material is soft and tacky and is applied in that condition by conventional methods to the undersurface of the end closure flange and to an adjacent portion of the end closure countersink wall. The end is seamed to the container with or without heat depending on the nature of the product packaged in the container, and on the type of solvent used in the sealant. For example, sanitary containers for certain food products such as vegetables and those employing a sealant having a heptane solvent must be dried with heat to purify the sealant and to drive off the hexane solvent.

A suitable filler material for sealants for beer and carbonated beverages container seams is Buca clay, a generic name for a hydrous aluminum silicate commercially available from various manufacturers such as Southern Clays Incorporated. The filler materials usually include commercially available oxides such as zinc oxide and titanium dioxide. These are used as coloring and reinforcing agents for the sealants. Also often included is a substantially asbestos-free anhydrous aluminum silicate such as that manufactured and sold as Mistron Talc by the Mistron Vapor Company.

Examples of rubber sealant materials suitable for seaming containers for packaging fatty or oily products, and having sufficient resistance to flow at the elevated processing temperatures required for such products are disclosed in U.S. Pat. No. 3,402,220 issued on Sept. 17, 1968. That Patent discloses end compounds made from homogeneous mixtures of soft solvent-soluble rubbers and relatively hard solvent insoluble rubbers. The rubber lining compounds are prepared by intimately mixing with a heavy duty mixer, a soft elastomeric copolymer of isobutylene such as butyl rubber and a diolefin, with a soft elastomeric chlorinated copolymer of isobutylene and a diolefin such as chlorobutyl rubber. This mixing is done in the presence of a curing agent such as zinc oxide for the chlorobutyl rubber, and while maintaining the temperature of the mixture below the curing temperature of the chlorobutyl rubber, advantageously below 260°F. Once complete blending is achieved, an acidic environment is provided by adding for example a stearic acid, and the temperature is raised to maintained preferably at about 330°F for about 15–60 minutes with or without mixing, until curing is complete and the resulting cured rubber base stock has a Mooney viscosity of from about 100 to 110. Then, separately, zinc resinate is dissolved in hexane, and Buca clay and butyl rubber in crumb form combined with the cured rubber base stock, are added to the solution to obtain a mixed rubber sealant material comprising from about 80–95% by weight butyl rubber based on the weight of the material.

It is thought that the invention and many of its attendant advantages will be understood from the foregoing description and it will be apparent that various changes may be made in the form, construction and arrangement of the parts of the articles and that changes may be made in the steps of the method described and their order of accomplishment without departing from the spirit and scope of the invention or sacrificing all of its material advantages, the form hereinbefore described being merely preferred embodiments thereof.

We claim:

1. A method of securing a metal container end closure to the marginal open end portion of an open-ended metallic cylindrical container body having an integral bottom and a metal body wall having a marginal open end portion whose thickness is less than about 0.0057 inch, to form a hermetically sealed container capable of holding internal pressures of up to about 90 psi developed at elevated temperatures of up to 140°F., which comprises:

providing an open-ended metallic cylindrical container body having an integral bottom and a metal body wall having a marginal open end portion whose thickness is less than about 0.0057 inch, forming an annular body curl of the marginal open end portion so that the curl has an edge which points toward the container body wall, providing a metal container end closure having merging panel portions including a central panel, an annular substantially vertical countersink wall portion peripheral to the central panel, and a peripheral flange, and hermetically securing the end closure to the curled marginal open end poriton of the body wall to form a container capable of holding internal pressures of up to about 90 psi developed at elevated temperatures of up to about 140°F. by providing a sealant material between the end closure countersink wall portion and the container body wall, bending the closure flange into a skirt and closure hook having an edge, mechanically engaging and exerting a compressive force by an end portion of the closure hook substantially axially against an end portion of the body curl, and axially compressing the body curl with the end portion of the closure hook to hermetically pressure-resistantly secure the end closure to the container body.

2. The method of claim 1 wherein the forming of the body curl includes forming the curl so that it has a radius of less than about 0.035 inch.

3. A method of securing a metal container end closure to the marginal open end portion of an open-ended composite cylindrical container body whose body wall includes a layer of full hard metal foil, whose marginal open end portion is less than about 0.002 inch thick, to form a hermetically sealed container capable of holding internal pressures of up to about 90 psi developed at elevated temperatures of up to about 140°F., which comprises:

providing an open-ended composite cylindrical container body whose body wall includes a layer of full hard metal foil and whose marginal open end portion is less than about 0.002 inch thick, forming an annular body curl of the marginal open end portion so that the curl has an edge which points toward the container body wall, providing a metal container end closure having merging panel portions including a central panel, an annular substantially vertical countersink wall portion peripheral to the central panel, and a peripheral flange, and hermetically securing the end closure to the curled marginal open end poriton of the body wall to form a container capable of holding internal pressures of up to about 90 psi developed at elevated temperatures of up to about 140°F. by providing a sealant material between the end closure countersink wall portion and the container body wall, bending the closure flange into a skirt and closure hook having an edge, mechanically engaging and exerting a compressive force by an end portion of the closure hook substantially axially against an end portion of the body curl, and axially compressing the body curl with the end portion of the closure hook to hermetically pressure-resistantly secure the end closure to the container body.

4. The method of claim 3 wherein the forming of the body curl includes forming the curl so that it has a radius of from about 0.020 to 0.035 inch.

* * * * *